US006348766B1

(12) United States Patent
Ohishi et al.

(10) Patent No.: US 6,348,766 B1
(45) Date of Patent: Feb. 19, 2002

(54) LED LAMP

(75) Inventors: Masatoshi Ohishi; Toyotaro Tokimoto, both of Yokohama; Fumio Imai, Nagoya, all of (JP)

(73) Assignees: Avix Inc., Yokohama; Central Japanese Railway Company, Nagoya, both of (JP)

( * ) Notice: Subject to any disclaimer, the term of this patent is extended or adjusted under 35 U.S.C. 154(b) by 0 days.

(21) Appl. No.: 09/706,633

(22) Filed: Nov. 6, 2000

(30) Foreign Application Priority Data

Nov. 5, 1999 (JP) ..... 11-315292

(51) Int. Cl.[7] ..... H05B 37/00

(52) U.S. Cl. ..... 315/200 A; 315/185 R; 315/312; 315/292; 315/316; 362/800; 362/806

(58) Field of Search ..... 315/291, 292, 315/293, 294, 295, 312, 360, 200 A, 185 R, 316; 362/800, 806, 812

(56) References Cited

U.S. PATENT DOCUMENTS 5,381,075 A * 1/1995 Jordon ..... 315/200 A
5,384,519 A * 1/1995 Gotoh ..... 315/324
5,969,479 A * 10/1999 Wong ..... 315/200 A
6,036,334 A * 3/2000 Nakano ..... 362/234
6,285,132 B1 * 9/2001 Conley, III et al. ..... 315/86

* cited by examiner

*Primary Examiner*—Don Wong
*Assistant Examiner*—Tuyet T. Vo

(57) ABSTRACT

A LED lamp with an integrally build-in a function for preannouncement end of life time in a LED lamp per se and to realize the LED lamp having such function with simple construction and at low cost. The LED lamp system has an alternating current power source connecting portion for receiving an alternating current, a power source converting portion for receiving the alternating current and rectifying the received alternating current for generating a direct current power, LED group consisted of a plurality of LEDs and received a direct current power output from the power source converting portion, the LED group having a life time preannouncement portion for integrating power supply period for issuing preannouncement indicative of approaching to the end of the life. The life time preannouncement portion includes counting means for measuring the power supply period on the basis of a frequency of the alternating power source, integrating means for integrating the power supply period measured by the counting means and storing the integrated value in a non-volatile memory, and power supply mode control means for controlling illumination of LEDs at different modes including a normal lighting modes, the power supply mode control means being responsive to an integrated value of the integrating means in excess of a predetermined criterion to operate in a predetermined life time preannouncement mode.

10 Claims, 2 Drawing Sheets

LED LAMP

BACKGROUND OF THE INVENTION

1. Field of the Invention

The present invention relates to a LED lamp employing a high-intensity light emitting diode (LED) as a light source. More particularly, the invention relates to a function of life time preannouncement of LED and notifying replacement timing thereof.

2. Description of the Related Art

As high-intensity blue LED has been put into practice, a LED lamp aggregatingly mounting red, green and blue color LEDs and driven by commercial alternating power source as general lighting equipment, has been in a stage of practical use. In comparison with a filament lamp or fluorescent lamp, LED lamps demonstrate a lot of advantages. Therefore, LED lamps will be spread significantly.

While the LED lamp has much longer life time than the filament lamp and fluorescent lamp, it still has a life time. Considering family use of the LED lamp, or use of the LED lamp as lighting equipment of a public space, such as an office, station or the like, the LED lamp is not well-seasoned as compared with the filament lamp or fluorescent lamp. Therefore,it should be difficult for general consumer to see the replacement timing of end of the life time of the LED lamp. Even though the LED lamp has quite long life time, it should be apparently and practically convenient to forecast replacement timing individually to notify to the manager.

SUMMARY OF THE INVENTION

The present invention has been worked out in view of the necessity as set forth above. It is therefore an object of the present invention to integrally build-in a function for pre-announcement end of life time in a LED lamp per se and to realize the LED lamp having such function with simple construction and at low cost.

According to one aspect of the present invention, a LED lamp system comprises:

an alternating current power source connecting portion for receiving an alternating current;

a power source converting portion for receiving the alternating current and rectifying the received alternating current for generating a direct current power;

LED group consisted of a plurality of LEDs and received a direct current power output from the power source converting portion, the LED group having a life time preannouncement portion for integrating power supply period for issuing preannouncement indicative of approaching to the end of the life, the life time preannouncement portion including:

counting means for measuring the power supply period on the basis of a frequency of the alternating power source, integrating means for integrating the power supply period measured by the counting means and storing the integrated value in a non-volatile memory, and power supply mode control means for controlling illumination of LEDs at different modes including a normal lighting mode, the power supply mode control means being responsive to an integrated value of the integrating means in excess of a predetermined criterion to operate in a predetermined life time preannouncement mode.

The power supply mode control means may check the integrated value stored in the non-volatile memory upon initiation of power supply so that the LED group is operated in the life time preannouncement mode for a predetermined period and in the normal lighting mode when the integrated value is in excess of the criterion.

The power supply mode control means may be set a plurality of criteria corresponding to a plurality of life time preannouncement levels for a plurality of mutually distinct preannouncement modes.

The LED lamp system may include a plurality of LED groups, each of which is consisted of a large number of LEDs of a color distinct from that of LEDs in other LED groups, and the power supply mode control means controls power supply modes of each color of LEDs.

The LED lamp system may further comprise light adjusting means for variably controlling illumination color of the LED groups by operating the power supply mode control means on the basis of an adjustment signal for illumination color and light amount applied externally.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure are not shown in detail in order to avoid unnecessary obscurity of the present invention.

Figure 1:
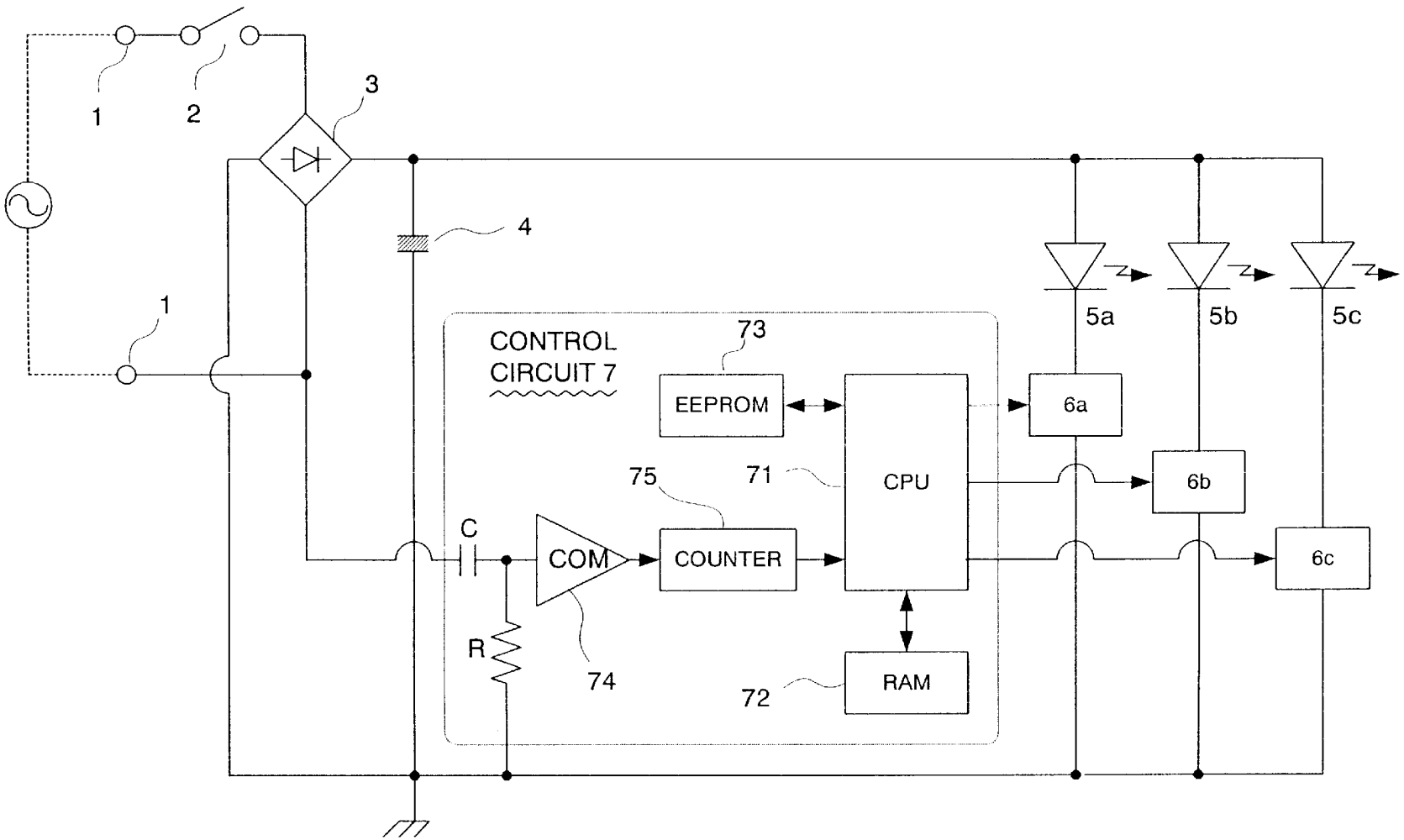
FIG. 1 is a block diagram showing an electrical construction of one embodiment of a LED lamp according to the present invention.

FIG. 1 is a block diagram showing an electrical construction of one embodiment of a LED lamp according to the present invention. An alternating current power source connecting portion is an electrical plug 1 adapted to a consent of generally 100V commercial alternating current power source. By inserting the electrical plug 1 into an effective power source consent and by turning on a power source switch 2, an alternating current power is rectified and smoothed by a diode-bridge rectifier circuit 3 and a capacitor 4 and thus converted into a direct current power. To a direct current power source line, a red LED group 5*a*, a green LED group 5*b* and a blue LED group 5*c* are connected via a red driver 6*a*, a green driver 6*b* and a blue driver 6*c*. It should be noted that, in the drawings, each color of the LED groups is represented by one LED. Actually, each color of LED group is consisted of a large number of LEDs. The LEDs in each color of LED group are connected in series or parallel. Also, three colors of LEDs are mounted in admixing manner to form an optical system so that three colors of lights are well mixed for emitting or diffusing an illuminating light.

Figure 2:
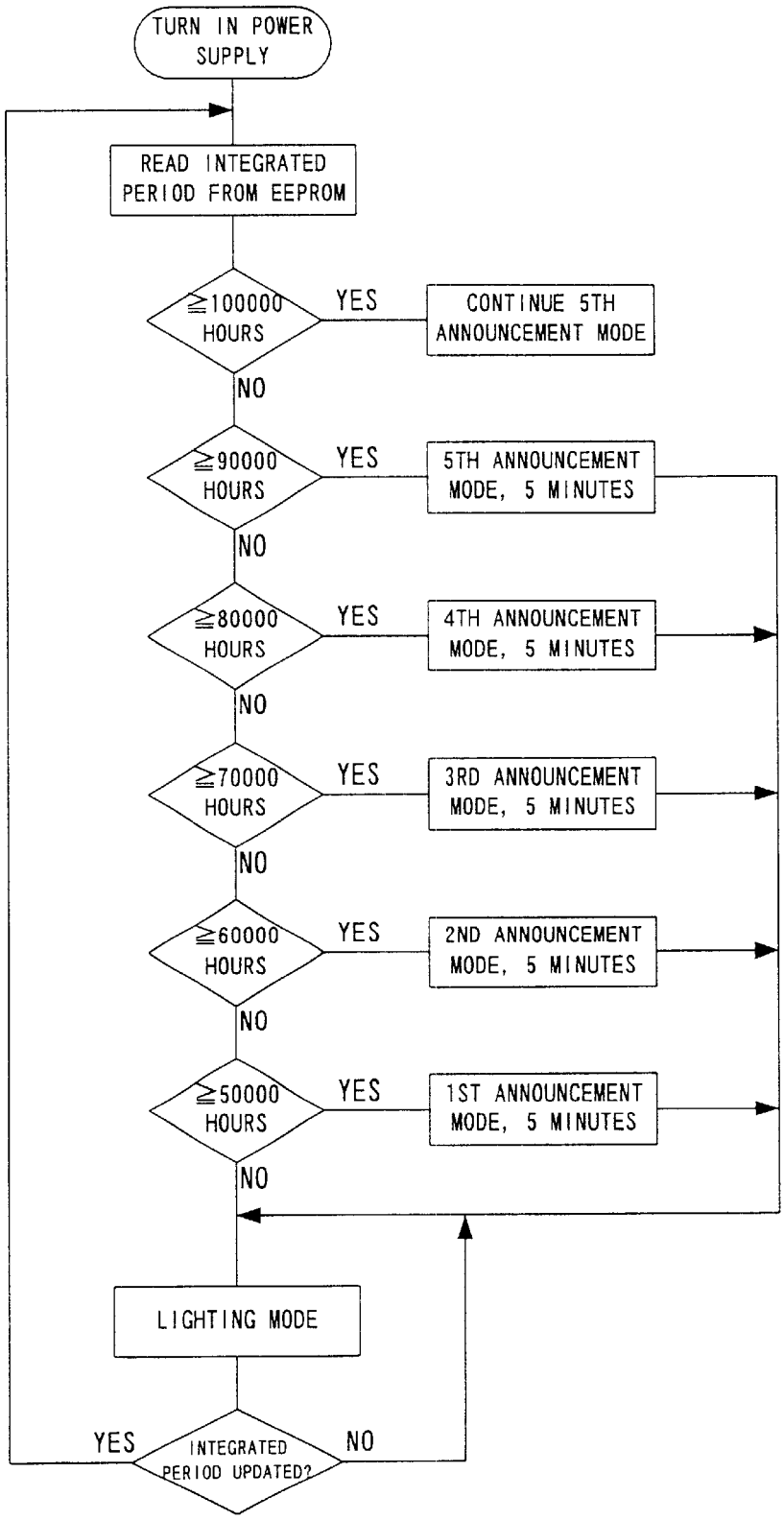
FIG. 2 is a flowchart showing a major point of the control procedure to be executed by CPU 71 in the foregoing embodiment.

A control circuit 7 is also operated by the direct current power source. The control circuit 7 is constructed with a microcomputer including CPU 71, RAM 72, EEPROM 73 (while not illustrated, it includes a power source circuit for appropriately lowering voltage). The control circuit 7 serves as integrating means, counting means, power supply mode control means and light adjusting means. Control process to be executed by CPU 71 is illustrated in a flowchart of FIG. 2.

The red driver 6*a*, the green driver 6*b* and blue driver 6*c* are controlled to be turned ON and OFF by a driver signal output individually by the control circuit 7. In normal lighting mode, the control circuit 7 continuously turns ON respective drivers 6*a*, 6*b* and 6*c* to illuminate respective of the red LED group 5*a*, the green LED group 5*b* and the blue LED group 5*c* at the maximum luminance.

A waveform of the alternating current power applied to the power source plug 1 is fed to a comparator 74 via a capacitor C and a resistor R for detecting zero-crossing of the alternating current power waveform. From the comparator 74, a pulse signal synchronous with the alternating current power is output. For instance, when the alternating current power is supplied at a frequency of 50 Hz, the pulse signal output from the comparator 74 should have the frequency of 50 Hz for synchronization with the alternating current power. A 16-bit counter 75 counts up the pulse signal. A carry signal of the counter 75 is counted by CPU 71 to record the counted value in RAM 72.

CPU 71 increments an integrated power supply period recorded in EEPROM 73 per one unit whenever the counted value of RAM 72 reaches a value corresponding to one hour. While the counted value of RAM 72 is lost when the power source switch 2 is turned OFF, the integrated power supply period recorded in EEPROM 73 will not be erased or lost. In this manner, frequency of writing access to the EEPROM 73 is reduced.

When the power source switch 2 is turned ON and thus CPU 71 is activated, the integrated power supply period recorded in EEPROM 73 is checked during initialization process. If the integrated power supply period does not reached 50000 hours yet, the respective colors of drivers 6*a*, 6*b* and 6*c* are held ON continuously for supply power to respective colors of LED groups 5*a*, 5*b* and 5*c* in normal lighting mode.

If the integrated power supply period is in a range of 50000 to 60000 hours, the drivers 6*a*, 6*b* and 6*c* are driven in a first preannouncement mode for five minutes. In the first preannouncement mode, the red LED group 5*a* and the green LED group 5*b* are illuminated continuously and the blue LED group 5*c* is illuminated intermittently for blinking. After five minutes in first preannouncement mode operation, the operation mode of the drivers 6*a*, 6*b* and 6*c* is switched into normal lighting mode to continuously illuminate all of the red LED group 5*a*, the green LED group 5*b* and the blue LED group 5*c*.

If the integrated power supply period is in a range of 60000 to 70000 hours, the drivers 6*a*, 6*b* and 6*c* are driven in a second preannouncement mode for five minutes. In the second preannouncement mode, the green LED group 5*b* and the blue LED group 5*c* are illuminated continuously and the red LED group 5*a* is illuminated intermittently for blinking. After five minutes in second preannouncement mode operation, the operation mode of the drivers 6*a*, 6*b* and 6*c* is switched into normal lighting mode to continuously illuminate all of the red LED group 5*a*, the green LED group 5*b* and the blue LED group 5*c*.

If the integrated power supply period is in a range of 70000 to 80000 hours, the drivers 6*a*, 6*b* and 6*c* are driven in a third preannouncement mode for five minutes. In the third preannouncement mode, the red LED group 5*a* and the blue LED group 5*c* are illuminated continuously and the green LED group 5*b* is illuminated intermittently for blinking. After five minutes in the third preannouncement mode operation, the operation mode of the drivers 6*a*, 6*b* and 6*c* is switched into normal lighting mode to continuously illuminate all of the red LED group 5*a*, the green LED group 5*b* and the blue LED group 5*c*.

If the integrated power supply period is in a range of 80000 to 90000 hours, the drivers 6*a*, 6*b* and 6*c* are driven in a fourth preannouncement mode for five minutes. In the fourth preannouncement mode, all of the red LED group 5*a*, the green LED group 5*b* and the blue LED group 5*c* are illuminated intermittently for blinking all together. After five minutes in the fourth preannouncement mode operation, the operation mode of the drivers 6*a*, 6*b* and 6*c* is switched into normal lighting mode to continuously illuminate all of the red LED group 5*a*, the green LED group 5*b* and the blue LED group 5*c*.

If the integrated power supply period is in a range of 90000 to 100000 hours, the drivers 6*a*, 6*b* and 6*c* are driven in a fifth preannouncement mode for five minutes. In the fifth preannouncement mode, the green LED group 5*b* and the blue LED group 5*c* are held OFF so as not to illuminated and the red LED group 5*a* is illuminated intermittently for blinking. After five minutes in the fifth preannouncement mode operation, the operation mode of the drivers 6*a*, 6*b* and 6*c* is switched into normal lighting mode to continuously illuminate all of the red LED group 5*a*, the green LED group 5*b* and the blue LED group 5*c*.

If the integrated power supply period is in excess of 100000 hours, the fifth preannouncement mode in which the green LED group 5*b* and the blue LED group 5*c* are held OFF so as not to illuminated and the red LED group 5*a* is illuminated intermittently for blinking, is maintained without entering into the normal lighting mode.

During each mode of operation, check of the integrated power supply period recorded in the EEPROM 73 is performed at every one hour, at which the integrated power supply period recorded in the EEPROM 73 is updated to perform corresponding preannouncement mode operation as required.

As set forth above, the LED lamp according to the present invention may integrate the power supply period by measuring power supply period for the LED groups on the basis of the frequency of the alternating current as power source and illuminate the LED groups in selected preannouncement mode when the integrated power supply period exceeds respective preannouncement criteria for notifying to the user or manager around the lamp the fact that end of the life time of the LED lamp is coming close. The manager or user may prepare for replacement when the preannouncement is given. Especially, it would be convenient to provide a plurality of life time preannouncement modes depending upon level of possible fatigue of the lamp.

While the present invention has been discussed in terms of the preferred embodiment, various modifications, omissions, additions and different designs without departing from the principle of the invention should be obvious to those skilled in the art. Therefore, the present invention should be understood as including all possible embodiments, modifications, omissions, additions and so forth which can be implemented without departing from the principle of the invention set forth in the appended claims.

For instance, it is possible to provide a lighting adjustment input means for externally providing an adjustment signal of illumination color or light amount for CPU 71 so that CPU 71 may control respective drivers 6*a*, 6*b* and 6*c* for adjusting tone of illumination light and/or light amount. It should be noted that, the alternating current power source connecting position is not inherently the power source plug but can be a lamp base of the filament lamp. Also, the power source switch 2 disclosed in the preferred embodiment is not essential for the present invention.

What is claimed is:

1. A LED lamp system comprising:

an alternating current power source connecting portion for receiving an alternating current;

a power source converting portion for receiving said alternating current and rectifying the received alternating current for generating a direct current power;

LED group consisted of a plurality of LEDs and receiving a direct current power output from said power source converting portion, said LED group having a life time preannouncement portion for integrating power supply period for issuing preannouncement indicative of approaching to the end of the life, said life time preannouncement portion including:

counting means for measuring said power supply period on the basis of a frequency of the alternating power source, integrating means for integrating the power supply period measured by said counting means and storing the integrated value in a non-volatile memory, and power supply mode control means for controlling illumination of LEDs at different modes including a normal lighting modes, said power supply mode control means being responsive to an integrated value of said integrating means in excess of a predetermined criterion to operate in a predetermined life time preannouncement mode.

2. A LED lamp system as set forth in claim 1, which includes a plurality of LED groups, each of which is consisted of a large number of LEDs of a color distinct from that of LEDs in other LED groups, and said power supply mode control means controls power supply modes of each color of LEDs.

3. A LED lamp system as set forth in claim 2, which further comprises light adjusting means for variably controlling illumination color of said LED groups by operating said power supply mode control means on the basis of an adjustment signal for illumination color and light amount applied externally.

4. A LED lamp system as set forth in claim 1, wherein said power supply mode control means is set a plurality of criteria corresponding to a plurality of life time preannouncement levels for a plurality of mutually distinct preannouncement modes.

5. A LED lamp system as set forth in claim 4, which includes a plurality of LED groups, each of which is consisted of a large number of LEDs of a color distinct from that of LEDs in other LED groups, and said power supply mode control means controls power supply modes of each color of LEDs.

6. A LED lamp system as set forth in claim 5, wherein which further comprises light adjusting means for variably controlling illumination color of said LED groups by operating said power supply mode control means on the basis of an adjustment signal for illumination color and light amount applied externally.

7. A LED lamp system as set forth in claim 1, wherein said power supply mode control means checks the integrated value stored in said non-volatile memory upon initiation of power supply so that said LED group is operated in said life time preannouncement mode for a predetermined period and in said normal lighting mode when said integrated value is in excess of said criterion.

8. A LED lamp system as set forth in claim 7, wherein said power supply mode control means is set a plurality of criteria corresponding to a plurality of life time preannouncement levels for a plurality of mutually distinct preannouncement modes.

9. A LED lamp system as set forth in claim 7, which includes a plurality of LED groups, each of which is consisted of a large number of LEDs of a color distinct from that of LEDs in other LED groups, and said power supply mode control means controls power supply modes of each color of LEDs.

10. A LED lamp system as set forth in claim 9, wherein which further comprises light adjusting means for variably controlling illumination color of said LED groups by operating said power supply mode control means on the basis of an adjustment signal for illumination color and light amount applied externally.

* * * * *